US009381391B1

(12) United States Patent
Welty, II

(10) Patent No.: US 9,381,391 B1
(45) Date of Patent: Jul. 5, 2016

(54) JUMP ROPE

(71) Applicant: John R. Welty, II, Billings, MT (US)

(72) Inventor: John R. Welty, II, Billings, MT (US)

(73) Assignee: Fastarrows, LLC, Billings, MT (US)

( * ) Notice: Subject to any disclaimer, the term of this patent is extended or adjusted under 35 U.S.C. 154(b) by 20 days.

(21) Appl. No.: 14/610,788

(22) Filed: Jan. 30, 2015

(51) Int. Cl.
*A63B 5/20* (2006.01)

(52) U.S. Cl.
CPC ..... *A63B 5/20* (2013.01)

(58) Field of Classification Search
CPC ..... A63B 5/20; A63B 5/205
See application file for complete search history.

(56) References Cited

U.S. PATENT DOCUMENTS

| | | | | |
|---|---|---|---|---|
| 4,101,123 | A * | 7/1978 | Anthony | A63B 5/20 482/82 |
| 4,801,137 | A * | 1/1989 | Douglass | A63B 21/075 482/108 |
| 6,544,149 | B2 | 4/2003 | O'Shea | |
| 6,551,222 | B1 | 4/2003 | Beaver | |
| 6,736,763 | B1 * | 5/2004 | Hsu | A63B 5/20 482/126 |
| 6,752,746 | B1 | 6/2004 | Winkler et al. | |
| 7,169,091 | B2 | 1/2007 | St. George et al. | |
| 7,223,211 | B2 | 5/2007 | O'Shea | |
| 7,341,544 | B2 | 3/2008 | St. George et al. | |
| 7,789,809 | B2 | 9/2010 | Borth et al. | |
| 7,819,783 | B2 | 10/2010 | St. George et al. | |
| 8,136,208 | B2 | 3/2012 | Borth et al. | |
| 2001/0011054 | A1 | 8/2001 | O'Shea | |
| 2004/0072658 | A1 | 4/2004 | St. George et al. | |
| 2004/0097345 | A1 | 5/2004 | O'Shea | |
| 2006/0035761 | A1 | 2/2006 | Saint George et al. | |
| 2007/0191195 | A1 | 8/2007 | St. George et al. | |
| 2009/0247372 | A1 | 10/2009 | Borth et al. | |
| 2009/0247373 | A1 | 10/2009 | Borth et al. | |

* cited by examiner

*Primary Examiner* — Oren Ginsberg
(74) *Attorney, Agent, or Firm* — Antoinette M. Tease

(57) ABSTRACT

A jump rope comprising cable and handle assemblies. The handle assembly comprises grip and bearing sections, the bearing section threadably connected to the grip section and comprising a housing and a heim joint, the heim joint comprising a metal ball that swivels within the heim joint housing. The grip section comprises female threads tor receiving a male threaded end of the bearing section. The cable assembly comprises a cable and cable stop. The cable is attached to the heim joint by slidably inserting a cable end through the aperture in the ball. A distal end of the heim joint comprises internal female threads that engage with a male threaded proximal end of a rotatable shaft located within the bearing housing. The rotatable shaft is supported by first and second ball bearings located on either end of the shaft so that the rotatable shaft may rotate freely within the bearing housing.

9 Claims, 3 Drawing Sheets

JUMP ROPE

BACKGROUND OF THE INVENTION

1. Field of the Invention

The present invention relates to the field of exercise jump ropes, and more specifically, to a jump rope with a two-part handle assembly (bearing section and grip section) that imparts superior durability and performance over prior art jump ropes.

2. Description of the Related Art

Although there are a number of issued U.S. patents and patent applications that describe advanced-technology jump ropes, none of these inventions has the features of the present invention, which include high durability, speed, and optimized ergonometrics. In terms of structure, the present invention incorporates a two piece, high-strength handle that comprises a grip section and a removable bearing section, with bearings that allow rotational and pivotable movement of the cable.

U.S. Pat. No. 6,544,149 (O'Shea, 2003) and U.S. Pat. No. 7,223,211 (O'Shea, 2007) disclose a jump rope having T-shaped handles, with each handle incorporating a spherical swivel element within the handle that is attached to the rope, and a method for using the jump rope.

U.S. Pat. No. 6,551,222 (Beaver, 2003) discloses a jump rope having hollow handles with external grip surfaces, rotational ball bearings in each handle, an adjustable friction brake to control rope speed, and an adjustable rope length capability.

U.S. Pat. No. 6,752,746 (Winkler et al., 2004) discloses a jump rope having a hollow handle that accepts weights, a rope-length adjusting mechanism, and a spherical bearing that allows the rope to rotate with respect to the handles.

U.S. Pat. No. 7,169,091 (St. George et al., 2007) discloses a jump rope having economically shaped handles and a spherical swivel bearing that allows the rope to rotate with respect to the handles.

U.S. Pat. No. 7,341,544 (St. George et al., 2008) and U.S. Pat. No. 7,819,783 (St. George, et al., 2010) discloses a jump rope having an improved asymmetric handle and a spherical swivel hearing.

U.S. Pat. No. 7,789,809 (Borth, et al., 2010) and U.S. Pat. No. 8,136,208 (Borth, et al., 2012) disclose a jump rope system having several embodiments of handles with rotatable bearings. One embodiment incorporates a two-piece rotatable shaft supported by a pair of ball bearing elements and a swiveling ball link element.

BRIEF SUMMARY OF THE INVENTION

The present invention is a jump rope comprising: a handle assembly comprising a grip section and a bearing section, wherein the bearing section is removably and threadably connected to the grip section, wherein the bearing section comprises a bearing housing and a heim joint, wherein the heim joint comprises a metal ball near a proximal end of the heim joint, the metal ball being free to swivel and pivot within a housing of the heim joint, wherein the ball comprises an aperture that passes through a center of the ball, and wherein a proximal end of the grip section comprises female threads for receiving a male threaded distal end of the bearing section; and a cable assembly comprising a cable and at least one cable stop, wherein a first end of the cable is attached to the heim joint by slidably inserting the first end of the cable through the aperture in the ball of the heim joint; wherein a distal end of the heim joint comprises internal female threads that engage with a male threaded proximal end of a rotatable shaft that is located within the bearing housing; and wherein the rotatable shaft is supported by a first ball bearing at a distal end of the rotatable shaft and a second ball bearing at a proximal end of the rotatable shaft so that the rotatable shaft may rotate freely within the bearing housing, and wherein there are no parts between the first and second ball bearings and the rotatable shaft.

In a preferred embodiment, the bearing section is a separate assembly from the grip section, and the bearing section is not situated within the grip section. Preferably, the first and second ball bearings are both positioned around the rotatable shaft and not about any part of the heim joint. The first and second ball bearings each has an inner diameter and an outer diameter, the first and second ball bearings preferably have the same inner and outer diameters, and the rotatable threaded shaft preferably has a constant outer diameter.

In a preferred embodiment, the grip section is a hollow aluminum tube. Preferably, the grip section comprises a first section and a second section, the first section has a smooth outer surface, and the second section is knurled with a diamond-shaped pattern to improve gripping. The invention preferably further comprises a first washer between the first ball bearing and a socket head of the rotatable shaft and a second washer between the second ball bearing and a distal end of the housing of the heim joint.

In a preferred embodiment, each of the rotatable shaft, the bearing housing, and a female threaded portion of the heim joint has a length, and the lengths of the rotatable shaft, the bearing housing, and the female threaded portion of the heim joint are selected so that there is no longitudinal compressive force applied to the first and second ball bearings when the rotatable shaft is fully threaded into the heim joint. Preferably, the first ball bearing is positioned within a first cylindrical cavity in the bearing housing, and the second ball bearing is positioned within a second cylindrical cavity within the bearing housing.

REFERENCE NUMBERS

Figure 1:
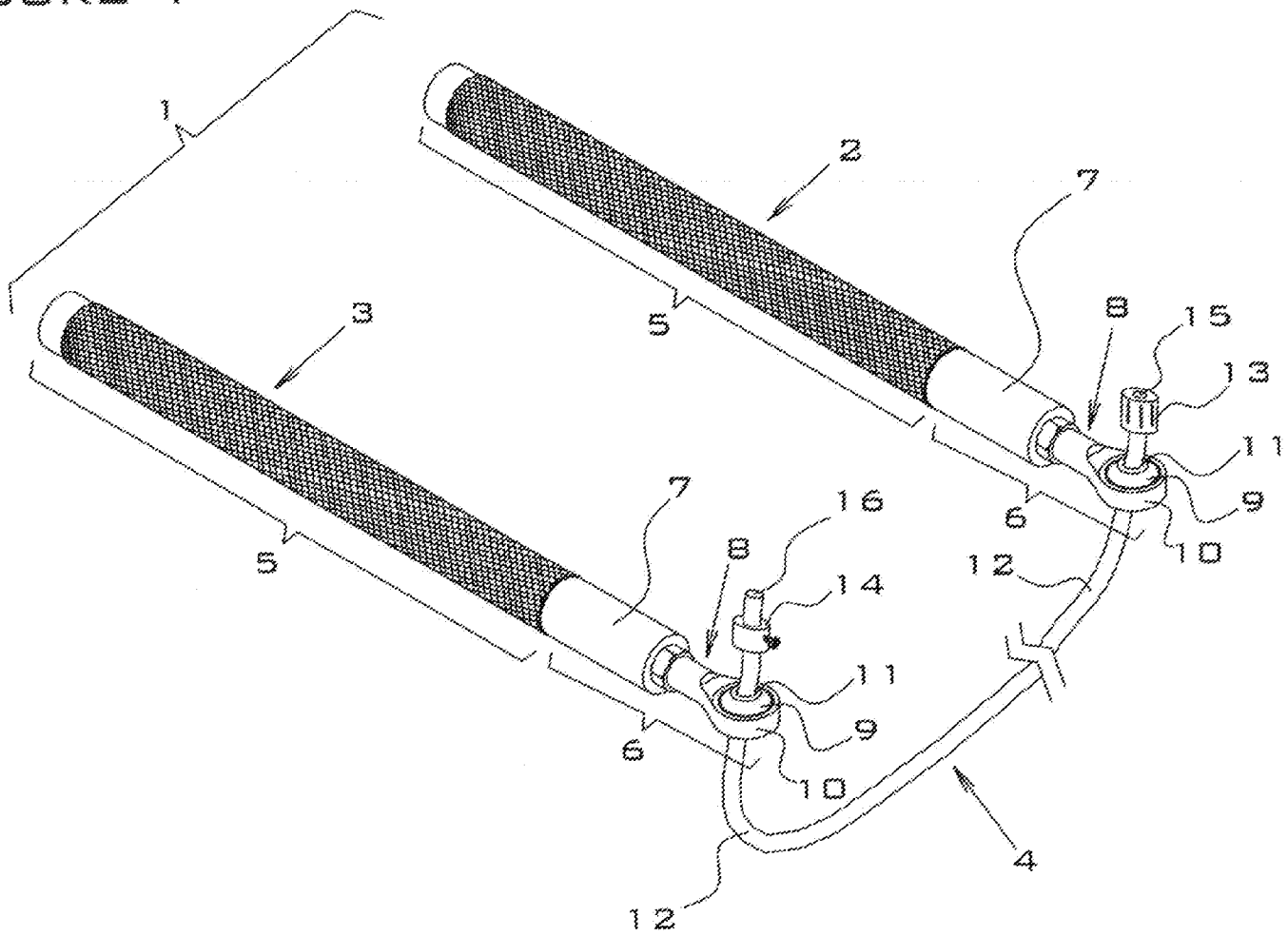
FIG. 1 is an isometric view of the present invention.

1 Jump rope device, present invention
2 First handle assembly
3 Second handle assembly
4 Cable assembly
5 Grip section
6 Bearing section
7 Bearing housing
8 Heim joint
9 Ball of a heim joint
10 Housing of a heim joint
11 Aperture in the ball of a heim joint
12 Cable
13 Crimped-on cable stop
14 Set-screw cable stop
15 First cable end
16 Second cable end

17 First section of grip outer surface, smooth section
18 Second section of the grip outer surface, knurled section
19 Rotatable shaft
20 First ball bearing
21 Second ball bearing
22 Washer
23 Female threaded section of the bearing housing
24 First cylindrical cavity
25 Second cylindrical cavity

DETAILED DESCRIPTION OF INVENTION

The present invention is a highly durable and efficient exercise jump rope designed for athletes, military personnel, and other serious exercisers. The handles are made of thick-wall machined aluminum that is highly resistant to normal wear and accidental damage. The cable is made of vinyl-coated stranded wire rope that is selected to be well-balanced for speed and efficiency. The two-part handle assembly incorporates an ergonometric grip that is threadably attached to a removable bearing assembly. The bearing assembly contains two sets of bearings that prevent the cable from kinking or twisting when the jump rope is used for exercise. The grip and bearing assembly may be screwed apart, and either component may be individually replaced if required. The details of the present invention are shown in the following FIGS. 1 through 5.

FIG. 1 is an isometric view of the present invention, which is a jump rope device 1, shown with the central portion of the cable removed. The present invention 1 comprises two identical handle assemblies—that is, a first handle assembly 2 and a second handle assembly 3—and a cable assembly 4. Each handle assembly 2, 3 comprises a grip section 5 and a bearing section 6, wherein the bearing section 6 is removably and threadably connected into the proximal end of the grip section 5 (the proximal end is the end nearest the cable assembly 4). Each bearing section 6 comprises a bearing housing 7 and a heim joint 8 (also known as a ball joint rod end or rod end bearing). Each heim joint 8 comprises a metal ball 9 near the proximal end that is free to swivel or pivot within a housing 10 of the heim joint 8, and each ball 9 contains an aperture 11 that passes through the center of the ball 9. The distal end of each heim joint 8 comprises internal female threads (shown in the following FIGS. 3 and 5) that attach to the male threaded proximal end of a rotatable shaft that is located within the bearing housing 7. The grip section 5 is a hollow aluminum tube that is described in detail in reference to FIG. 3.

The cable assembly 4 includes a cable 12. a crimped-on cable stop 13 and a set-screw cable stop 14. The crimped-on cable stop 13 is permanently and non-adjustably affixed around a first cable end 15 of the cable 7 with a standard crimping tool. The set-screw cable slop 14 is adjustably affixed around a second cable end 16 of the cable 7. The first cable end 15 is attached to the heim joint 8 of the first handle assembly 2 by slidably inserting the first cable end 15 through the aperture 11 in the ball 9 of the heim joint 8, and the second cable end 16 of the cable 7 is similarly attached to the heim joint 8 of the second handle assembly 3 by slidably inserting it through the aperture 11 within the ball 9 of the heim joint 8.

The length of the cable 7 between the two handle assemblies 2 and 3 is adjustable by sliding more or less length of the cable 7 through the aperture 11 of the heim joint 8 of the second handle assembly 3 and through the loosened set-screw cable stop 14 and then tightening the set screw of the set-screw cable stop 14 against the cable 7 when the cable 7 is adjusted to the desired length. Once the cable length has been properly adjusted for a user, excess cable may be optionally permanently removed from the second cable end 16 of the cable 7 by clipping it off with wire cutters. The outside diameter of the cable 7 and the inside diameter of the apertures 11 are selected so that the cable 7 is free to slide within the apertures 11; therefore, when the jump rope assembly 1 is spun around during normal use for exercise (i.e., the cable is made to pass over the user's head and underneath the user's feet), centrifugal force on the cable 7 causes the cable 7 to slide within the apertures 11 so that the crimped-on cable connector 13 butts up against the ball 9 of the heim joint 8 of the first handle assembly 2, and the set-screw cable stop 14 butts up against the ball 9 of the heim joint 8 of the second handle assembly 3.

The cable assembly 4 is free to pivot and rotate about the axes of the handle assemblies 2 and 3 as a result of the freedom of movement provided by the pivotable balls 9 of the heim joints 8 and also the rotatable linkages that are incorporated within the bearing section 6, shown in more detail in the following FIGS. 3 through 5. The ability of the cable 7 to rotate and pivot during exercise presents kinking and twisting of the cable 7, thereby resulting in the present invention being more efficient and faster compared to a jump rope having a cable or rope that cannot rotate and/or pivot with respect to the handles.

In a preferred embodiment, the heim joints 6 are Rod End Bearing NHS-3, manufactured by the Lishui Well Bearing Company of Lishui, China, the crimped-on cable stop is an aluminum LOCOLOC™ stop sleeve manufactured by Loos and Company of Naples, Fla., and the set-screw cable stop is a custom product manufactured by the Shanxi Fuding International Trade Co, Ltd. of Taiyuan City, China. The cable is a 1/16-inch diameter, multiple-strand wire rope that is vinyl-coated so as to have an outside diameter of 3/32-inch, available as a generic item from numerous manufacturers.

Figure 2:
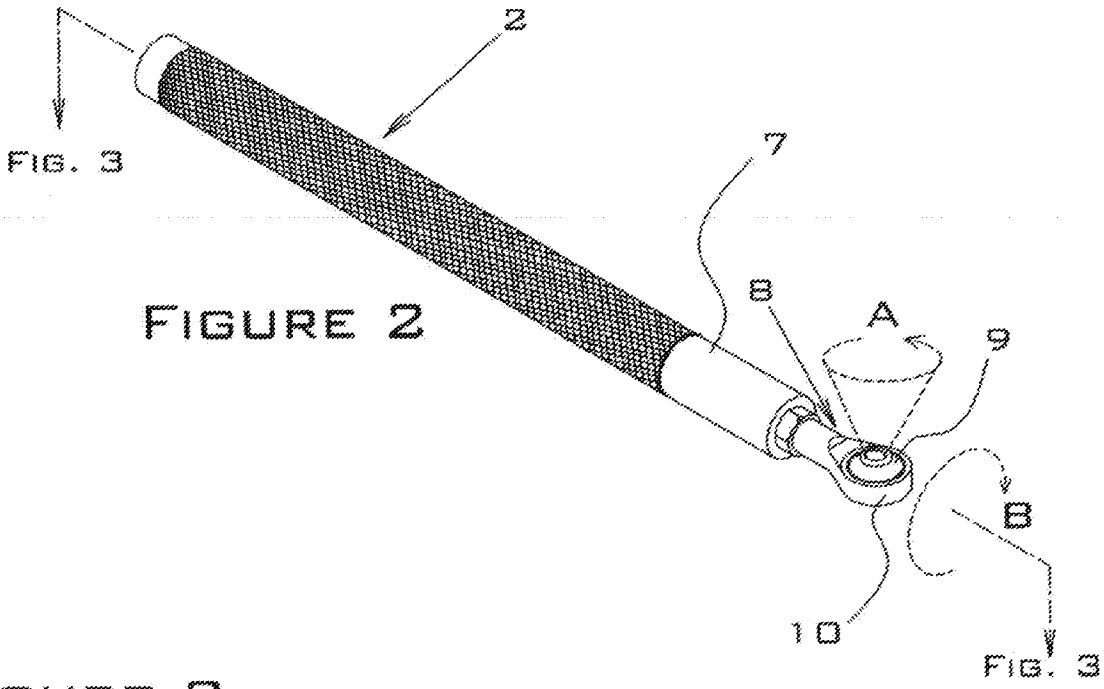
FIG. 2 is an isometric view of the handle assembly.

FIG. 2 is an isometric view of the handle assembly 2, showing the rotational and pivotal movements of the heim joint 8 that occur when the cable assembly 4 (shown in FIG. 1) is swung around the user during normal use of the present invention. As previously described, the handle assembly 3 is identical to the handle assembly 2. The dashed circle A illustrates the range of pivotable motion that is possible due to the ability of the ball 9 to swivel or pivot within the housing 10 of the heim joint 8. This pivotable movement has an axis of rotation whose center is perpendicular to the longitudinal axis of the handle (i.e., the axis of rotation of circle A is perpendicular to the longitudinal axis of the handle). The dashed circle B illustrates the rotational movement of the heim joint 8 around the axis of the handle assembly 2 (i.e., the axis of rotation of circle B is congruent with the longitudinal axis of the handle) that is provided by the shaft and bearings that are located within the bearing housing 7, as shown in detail in the following FIGS. 3 through 5. Note that the directions of rotation illustrated by the arrows of circles A and B are bi-directional; e.g., the rotations can be cither clockwise or counterclockwise with equal freedom of movement.

Figure 3:
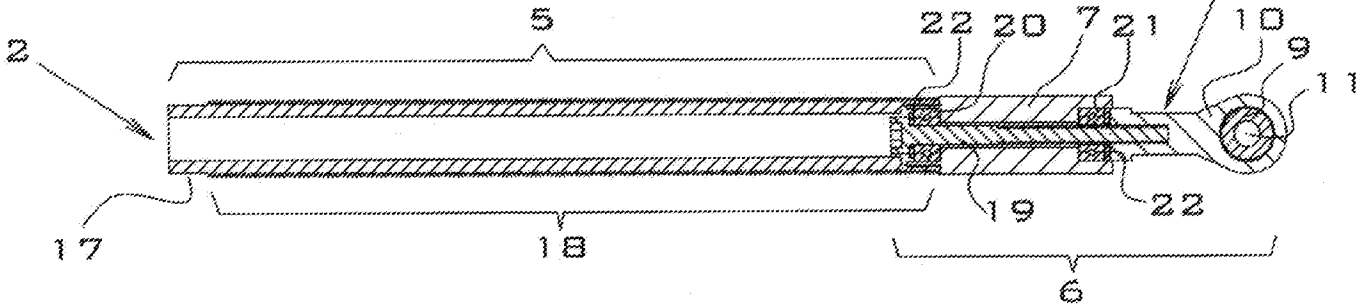
FIG. 3 is a longitudinal cross-section view of the handle assembly.

FIG. 3 is a longitudinal cross-section view of the handle assembly 2 taken at the section line shown in FIG. 2. Major components include the grip section 5 and the bearing section 6. The grip section 5 is preferably manufactured from hollow, thick-walled aluminum tubing having an outside diameter of about 0.47 inch and an inside diameter of about 0.30 inch. A first section 17 of the outer surface around the circumference of the grip section 5 near the distal end is kept smooth for application of a brand name, logo, etc., and a second section 18 of the outer surface is knurled with a diamond-shaped pattern to improve gripping. The smooth section 17 and the knurled section 18 of the outer surface are preferably treated with a corrosion-resistant finish such as anodization or powder coating. The proximal end of the inside circumference of the grip section 5 is machined and threaded with female threads so as to accept and attach to the distal male-threaded end of the bearing section 6. In a preferred embodiment, the grip section 5 has an overall length of about 6.12 inches, the smooth section 17 has a length of about 0.24 inches, and the knurled section 18 has a length of about 5.88 inches. The distal end of the grip 5 is preferably open (i.e., not plugged or capped).

The bearing section 6 comprises a bearing housing 7, which has a machined internal bore that contains a rotatable shaft 19 that is preferably a socket head cap bolt. The bearing housing is preferably machined from thick-walled aluminum tubing having an outside diameter of about 0.47 inch and a bore diameter of about 0.15 inch. The rotatable shaft 19 is supported by a first ball bearing 20 near the distal end of the rotatable shaft 19 and a second ball bearing 21 near the proximal end of the rotatable shaft 19. In a preferred embodiment, the rotatable shaft 19 has an overall length of about 1.68 inches, a shaft length of 1.57 inches, and a shaft diameter of about 0.12 inches. The proximal end of the rotatable shaft 19 comprises male threads that screw into the female threads of the distal end of the housing 10 of the heim joint 8. A washer 22 is placed between the socket head of the rotatable shaft 19 and the first ball bearing 20 and also between the second ball bearing 21 and the distal end of the housing 10 of the heim joint 8. The components of the bearing section 6 are shown in more detail in the following FIGS. 4 and 5. In a preferred embodiment, the rotatable shaft 19 is an M3 Socket Cap Bolt manufactured by Tong Ming Enterprises Co., Ltd, if Zhejaing Provence, China, and the half bearings 21 are DDR-830ZZ bearings manufactured by the NMB Bearing Company of Chatsworth, Calif.

Figure 4:
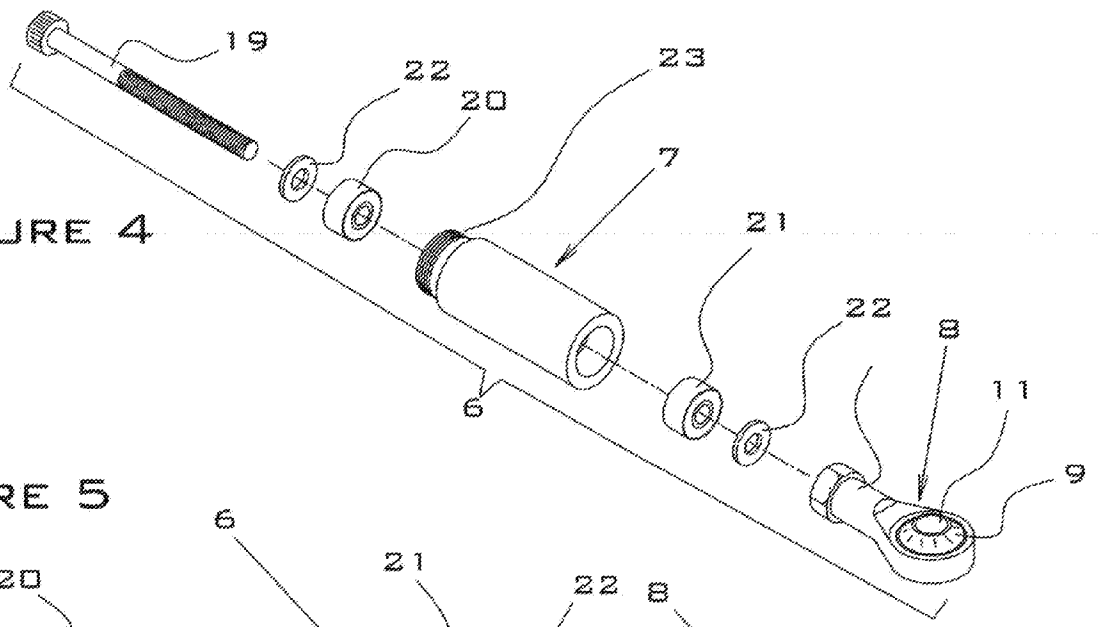
FIG. 4 is an exploded isometric view of the bearing section of the handle assembly.

FIG. 4 is an exploded isometric view of the bearing section 6, showing the assembly configuration of the rotatable shaft 19, the washers 22, the first ball bearing 20, the bearing housing 7, the second ball bearing 21 and the heim joint 8. The female threaded section 23 on the distal end of the bearing housing 7 is also shown. In a preferred embodiment, the female threaded section 23 of the bearing housing 7 has an outside diameter of about 0.39 inch and a length of about 0.20 inch.

Figure 5:
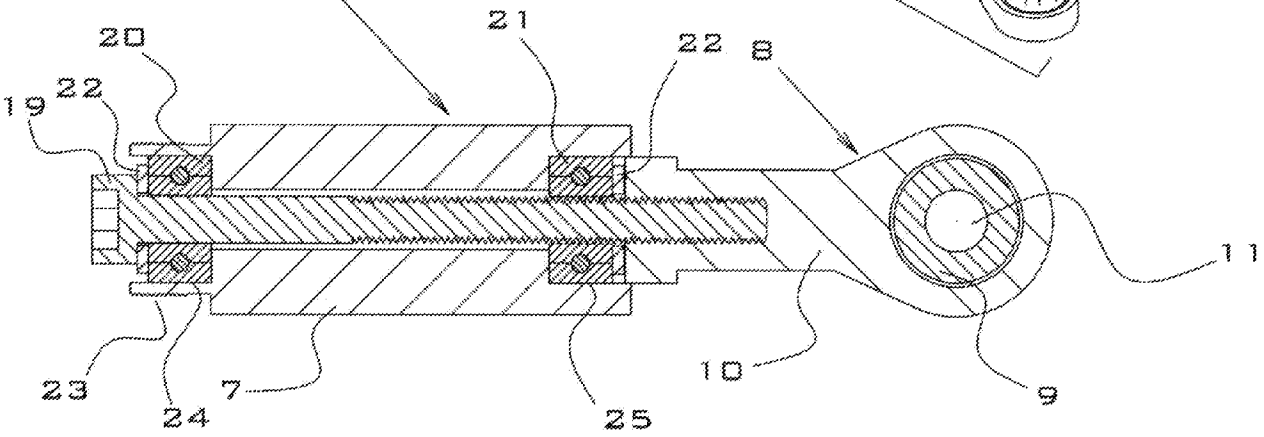
FIG. 5 is a magnified longitudinal cross-section view of the bearing section of the handle assembly.

FIG. 5 is a magnified longitudinal cross-section view of the bearing section 6 shown with the components assembled, taken at the section line shown in FIG. 2. As shown, the rotatable shaft 19 is supported within the bore of the bearing housing 7 by the two ball bearings 20 and 21 so that the rotatable shaft 19 may freely rotate within the bearing housing 7. As shown, the proximal end of the rotatable shaft 19 is fully screwed into the heim joint 8 so that the male threaded portion of the rotatable shaft 19 bottoms against the female threaded portion of the heim joint 8. The lengths of the rotatable shaft 19, the bearing housing 7 and the threaded portion of the heim joint 8 are selected so that there is no longitudinal compressive force applied to the ball bearings 20 and 21 when the rotatable shaft 19 is fully threaded into the heim joint 8; i.e., there are a few hundreds of an inch of longitudinal "play" of the rotatable shaft 19 within the bearing housing 7 when the components are fully assembled and tightened. This play ensures free rotation of the rotatable shaft within the bearing housing 7 when the present invention is used.

The first ball bearings 20 and the second ball bearing 21 are positioned within a first cylindrical cavity 24 and a second cylindrical cavity 25, respectively, that are machined into the bearing housing 7. Because these cylindrical cavities 24 and 25 are machined, they can be precisely dimensioned and positioned so that the two ball bearings 20 and 21 can be kept in accurate coaxial alignment with no "wobble" movement of the bearings within the cavities due to gaps between the ball bearings and the cavity walls, thereby minimizing friction to the rotatable shaft 19 and/or wear to the various components of the bearing section 6. Because the rotatable shaft 19 has a constant diameter along its shaft length, the ball bearings 20 and 21 can be identical parts and the cylindrical cavities 24 and 25 can have identical dimensions.

The invention described in U.S. Pat. No. 8,136,208 (Borth et al., 2010) shares some of the same structural features as the present invention; however, there are several significant structural differences between the invention of Borth et al. and the present invention. First, in the present invention, the bearing section is manufactured as an assembly that is made separately from the grip section of the handle, whereas all of the Borth embodiments comprise bearing components that are installed within the handle grip (see Borth, col. 3, lines 58-65, describing the fact that the handle means retains the first and second bearing elements). For this reason, the present invention provides manufacturing advantages over the Borth invention. For example, referring to Borth's FIG. 5, the bearing element 10 is positioned within a cavity in the handle. Machining this cavity would be challenging because the machining tools would need to be inserted through the relatively long and narrow hollow interior of the handle, making accurate machining difficult. Alternately, if a molded plastic handle were used for the Borth device, the molded plastic cavity that supports the bearing element 10 would not have the strength or durability of the machined cavities of the present invention.

The two-piece handle (separate grip and bearing sections) of the present invention also has advantages over Borth's one-piece handle from a commercial sales perspective; for example, a single model of the bearing section could be made to be compatible with a variety of different handles (of different color, length, logo, etc.), thereby reducing the inventory requirements for a seller. In addition, if a jump rope assembly had a problem with either the grip section or the bearing section, only the defective portion would need to be replaced with the present invention.

A second structural difference between the Borth invention and the present invention is the arrangement of the rotatable shaft and ball bearings. Borth discloses an embodiment of a rotating and pivoting bearing assembly that comprises a rotatable threaded shaft that is attached to a ball link and comprising two bearing elements (see Borth FIG. 9). Both describes this embodiment as having a two-piece shaft because it employs the first bearing element around the threaded shaft and the second bearing element around the ball link (i.e., the threaded shaft and the ball link are both components of the shaft). Significantly, the two ball bearings of the present invention are both positioned around the rotatable threaded shaft, but there is no ball bearing around the heim joint in the Borth embodiments, any axial misalignment between the threaded shaft and the ball link will cause undesirable axial "wobble" forces to be placed upon the two bearing elements as the threaded shaft and the ball link rotate together. By contrast, in the present invention, any axial misalignment between the threaded shaft and the heim joint will not produce axial forces on the two ball bearings because only the single-piece threaded shaft is constrained by the two ball bearings.

A further distinction between the present invention and the Borth invention is the relative size of the two ball bearings as it relates to the outside diameter of the threaded rod. In the Borth embodiments that are shown in the drawings, the outside diameters of the threaded rod or shaft 9 (referred to by Borth as the "first shaft piece 37," FIG. 5) and that end of the ball joint 40 (referred to by Borth as the "cylindrical bearing surface 22 of the second shaft piece 38," FIG. 5) into which the threaded rod is inserted are different from each other, requiring two bearing elements having two different inside diameters (one size for the threaded rod and another size for the ball joint), which also results in two different outside diameters for the two bearing elements. Although Broth states that the two shaft pieces (i.e., the threaded rod and the ball joint) can be of "uniform diameter or of different diameters" (col. 4, line 63), he does not show such an embodiment, nor does he describe how a practical assembly could be made using two bearing elements having the same outside diameter (with one bearing element surrounding the threaded rod and the other bearing element surrounding the interior end of the blade element). The only way this could work would be if the end of the threaded rod that screws into the ball joint had a smaller outside diameter than that part of the threaded rod that does not screw into the ball joint (in other words, the threaded rod would need to have two different outside diameters); this design, however, would cause a structural weakness in that part of the threaded rod that screws into the ball joint.

In the Borth invention, if the two bearing elements 10, 11 are the same size (in other words, if they have the same outside and inside diameters), then the threaded rod cannot have a constant outside diameter. (This is because one of the bearing elements 10 surrounds the threaded rod, and the other bearing element 11 surrounds the interior end of the blade element.) Rather, it would need to have two different outside diameters, the end of the threaded rod that screws into the ball joint having the smaller outside diameter (so that the interior end of the blade element would have the same outside diameter as that part of the threaded rod that does not screw into the blade element). By contrast, the present invention comprises a threaded rod with a constant outside diameter (i.e., a diameter that does not change) along the entire length of the threaded rod, and it also comprises two ball bearings that are exactly the some size in terms of inside and outside diameters. The latter design has advantages in terms of strength and manufacturing. In a preferred embodiment of the present invention, identical parts are used for the two ball bearings. For the reasons explained above, identical parts cannot be used for the two bearing elements in Borth without using a threaded rod with two different outside diameters.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A jump rope comprising:

(a) a handle assembly comprising a grip section and a bearing section, wherein the bearing section is removably and threadably connected to the grip section, wherein the bearing section comprises a bearing housing and a heim joint, wherein the heim joint comprises a metal ball near a proximal end of the heim joint, the metal ball being free to swivel and pivot within a housing of the heim joint, wherein the ball comprises an aperture that passes through a center of the ball, and wherein a proximal end of the grip section comprises female threads for receiving a male threaded distal end of the bearing section; and (b) a cable assembly comprising a cable and at least one cable stop, wherein a first end of the cable is attached to the heim joint by slidably inserting the first end of the cable through the aperture in the ball of the heim joint;

wherein a distal end of the heim joint comprises internal female threads that engage with a male threaded proximal end of a rotatable shaft that is located within the bearing housing; and wherein the rotatable shaft is supported by a first ball bearing at a distal end of the rotatable shaft and a second ball bearing at a proximal end of the rotatable shaft so that the rotatable shaft may rotate freely within the bearing housing, and wherein there are no parts between the first and second ball bearings and the rotatable shaft.

2. The jump rope of claim 1, wherein the bearing section is a separate assembly from the grip section, and wherein the bearing section is not situated within the grip section.

3. The jump rope of claim 1, wherein the first and second ball bearings are both positioned around the rotatable shaft and not about any part of the heim joint.

4. The jump rope of claim 3, wherein the first and second ball bearings each have an inner diameter and an outer diameter, wherein the first and second ball bearings have the same inner and outer diameters, and wherein the rotatable threaded shaft has a constant outer diameter.

5. The jump rope of claim 1, wherein the grip section is a hollow aluminum tube.

6. The jump rope of claim 1, wherein the grip section comprises a first section and a second section, wherein the first section has a smooth outer surface, and wherein the second section is knurled with a diamond-shaped pattern to improve gripping.

7. The jump rope of claim 1, further comprising a first washer between the first ball bearing and a socket head of the rotatable shaft and a second washer between the second ball bearing and a distal end of the housing of the heim joint.

8. The jump rope of claim 1, wherein each of the rotatable shaft, the bearing housing, and a female threaded portion of the heim joint has a length, and wherein the lengths of the rotatable shaft, the bearing housing, and the female threaded portion of the heim joint are selected so that there is no longitudinal compressive force applied to the first and second ball bearings when the rotatable shaft is fully threaded into the heim joint.

9. The jump rope of claim 1, wherein the first ball bearing is positioned within a first cylindrical cavity in the bearing housing, and the second ball bearing is positioned within a second cylindrical cavity within the bearing housing.

* * * * *